United States Patent [19]

Thompson

[11] Patent Number: 4,838,440

[45] Date of Patent: Jun. 13, 1989

[54] DUAL-POSITION TABLE LEG BRACE

[76] Inventor: David M. Thompson, 834 Mantoloking Rd., Brick Town, N.J. 08723

[21] Appl. No.: 213,125

[22] Filed: Jun. 27, 1988

[51] Int. Cl.[4] ..... A47B 3/00

[52] U.S. Cl. ..... 248/188; 108/125

[58] Field of Search ..... 248/677, 514, 188, 188.1, 248/188.8, 314, 166, 436, 439; 108/125, 131, 132; 403/92, 94, 113

[56] References Cited

U.S. PATENT DOCUMENTS

| | | | |
|---|---|---|---|
| 1,342,951 | 6/1920 | Gagne | 248/188 |
| 1,946,620 | 2/1934 | Hallawell | 108/125 |
| 2,606,802 | 8/1952 | Inpyn | 108/125 |
| 2,625,454 | 1/1953 | Brown | 108/125 |
| 2,683,069 | 7/1954 | Kimmel | 108/125 |
| 2,796,268 | 6/1957 | Larson | 403/94 |
| 2,799,548 | 7/1957 | Arden | 108/125 |
| 2,838,353 | 6/1958 | Emmert | 108/125 |
| 2,911,273 | 11/1959 | Inpyn | 248/188 |
| 3,026,161 | 3/1962 | Mickelson | 108/125 |
| 3,126,189 | 3/1964 | Van Syoc | 248/188 |

*Primary Examiner*—Alvin C. Chin-Shue
*Assistant Examiner*—Robert A. Olson
*Attorney, Agent, or Firm*—Charles F. Gunderson

[57] ABSTRACT

A molded plastic mount for a folding table leg has a base portion with suitable means for fastening securely to the underside of a table top. A tubular pedestal portion extends downwardly from the base portion, and is long enough, and strong enough, to secure a tubular upper end of a table leg extending downwards to support the table top for use under normal conditions. This tubular pedestal portion is open on one side, and has a pivot through the pedestal and the top of the table leg to permit the table leg to be folded up against the underside of the table top in a storing or carrying position. Plastic lugs at the bottom of the pedestal, on either side of the opening, extend around the top of the table leg to secure it in its downward position, but are flexible enough to permit the table leg to be moved to its upward position, and secure it in that position.

3 Claims, 1 Drawing Sheet

DUAL-POSITION TABLE LEG BRACE

BACKGROUND OF THE INVENTION

There are many types of tables, and almost as many types of supports for the tables. Sometimes a single leg, anchored to the floor, or mounted on a very wide base can support the whole table, but usually there are three or more legs to hold the table in a stable position. There are very many means and mechanisms for supporting a table leg, or legs, under a table. Most of them are rigid to provide a permanent support for a fixed table. However there is a need for portable tables that can be set up anywhere they are needed, but still put away compactly for storage. These require removable legs, or folding legs, for simple set-up and dismantling, and for easier carrying or storing.

The simplest, and most effective of these portable tables, uses folding legs that, usually, pivot from the corners of the table, under the table top. These legs can be pivoted upwards, towards the table top, to lie under the table top in a carrying or storing position, or the legs can be pivoted downwards, away from the table top, to support the table. However, there has to be some means for holding the leg, particularly in the downward position. For this purpose, an auxilliary brace is almost always provided to lock the leg in a position more or less perpendicular to the table top to support the table.

These auxilliary braces, almost invariably, require metal brackets having one end positioned along the under side of the table, at a distance from the leg pivot, to support one end of the brace while the other end of the brace is positioned part way down the leg. The upper end of the basic leg may pivot about a single pin, but the bracket, necessary to hold the leg in its upward or downward position, is usually in the form of a removable element that may be hinged on the one end, with a means for connecting the other end part way down the leg - or vise-versa. An even more common bracket is collapsible with two segments, hinged or pivoted at either end and in the middle, that folds in half in the upward position, and extends straight in the downward position. This requires three pivot pins as well as a locking mechanism to hold the table leg securely in either position.

These brackets, pivots and accessories are usually of steel, and may or may not be galvanized, or sufficiently plated or painted, because of cost considerations, and are subject to mechanical malfunctions, increasing with time and age, as well as rust and wear, and unsightly discolorization.

It is an object of this invention to provide a simple molded plastic support brace for a folding table leg. The base of the support brace can be fastened securely to the under side of the table top, and the table leg can be pivoted between an upward and a downward position within the brace.

It is a further object of this invention to provide an improved support brace for a table leg that has no moving parts - except for the pivotable table leg - and that is simple, attractive, and relatively imune to rust, or corrosion, or other mechanical problems. This improved support brace includes resilient, deformable projections that can hold the table leg in either position.

SUMMARY OF THE INVENTION

A molded plastic bracket for holding a table leg has a base at its inner end to be secured to the underside of a table, and a half-tubular portion, open at one side and supporting the table leg. A pin through the bracket and the upper end of the table leg, permits the table leg to be pivoted, and move up and down through the opening on the one side. This allows motion of the leg, in only one plane, between a horizontal, upward position under the table top and a vertical, downward position to support the table for general use. The half-tubular portion of the molded base wraps around the top of the leg to help hold it steady, but a pair of resilient, projecting fingers at the outer end of the bracket wrap further around the leg to hold it firmly in its downward position. When the table leg is pivoted upward under the table top, these projecting, plastic fingers are resilient enough to spread to allow the leg to move to its upward positions, and then close tightly enough to hold the table leg rigidly in that position. These resilient fingers or lugs permit the passage of the leg to either position, and secure it in either position.

DETAILED DESCRIPTION OF THE DRAWINGS

Figure 1:
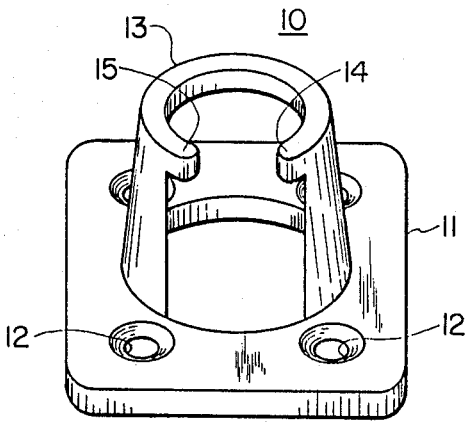
FIG. 1 is an isometric view of the overall bracket.

FIG. 1 shows an isometric view of the overall bracket 10, with a base 11, at its inner end, having screw or bolt holes, such as 12, for securing the base of the bracket under a table top. The bracket has a pedestal 13, forming an outer end, supported by the base 11. The outer end of the pedestal 13 is tubular, but is open at the outer end to accomodate the top of a leg, seen in FIGS. 2–7, which is also tubular. However, the pedestal has an open side, under the molded locking fingers or lugs 14 and 15, through which the top of the table leg can pivot.

In all of the figures, similar element are similarly numbered.

Figure 2:
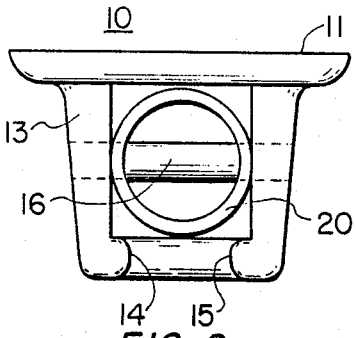
FIG. 2 is an end view of the bracket and table leg in its upward position.

FIG. 2 shows the bracket 10 in an end view, with the base 11 supporting the pedestal 13 to support the table leg 20, that turns about a pivot 16, in an upward position. The fingers or projections 14 and 15 are seen here to be in a position to hold the table leg in its upward position.

Figure 3:
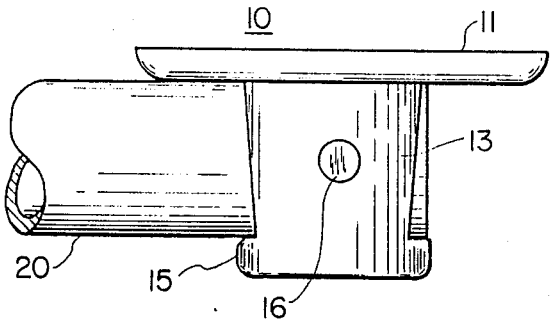
FIG. 3 is a side view of the bracket and a portion of the table leg in the upward position.

FIG. 3 shows a side view of the bracket 10 and the pedestal with part of the table leg in the same position. Here the pivot pin 16 is seen extending through the pedestal near the inner, center part of the pedestal. The table leg 20 is, again, held in it upward position by the fingers, such as 15.

Figure 4:
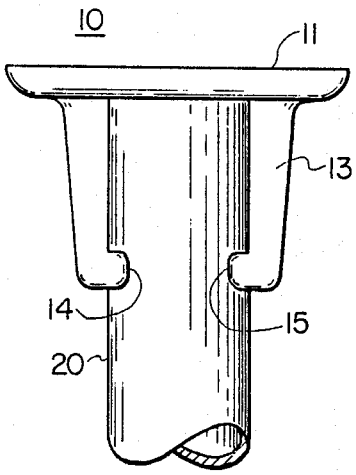
FIG. 4 is an end view of the bracket and a portion of the table leg in its downward position.
Figure 5:
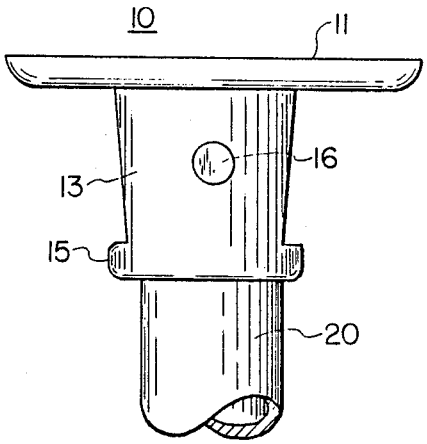
FIG. 5 is a side view of the bracket and a portion of the table leg in the downward position.

FIG. 4 is an end view of the bracket and pedestal with a portion of the table leg 20 in its downward position. The fingers or lugs 14 and 15 are now seen holding the table leg in its downward position FIG. 5 is a side view of the same position of the same device with the portion of the leg 20, pivoted about the pin 16, in its downward position, and held by the lugs such as 15.

Figure 6:
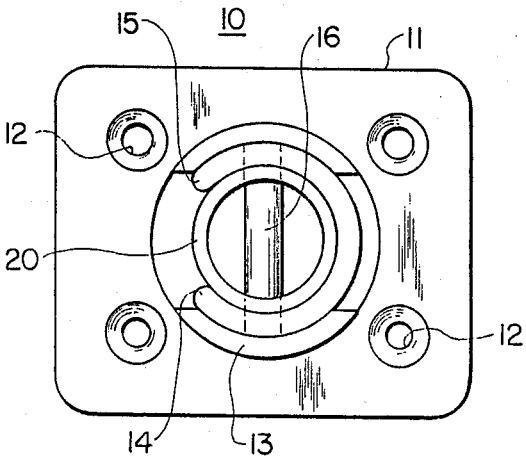
FIG. 6 is a bottom view of the bracket and table leg in its downward position.

FIG. 6 is a bottom view of the bracket 10 with its pedestal 13, lugs 14 and 15, and pivot pin 16, holding the leg 20 in a rigid downward position.

Figure 7:
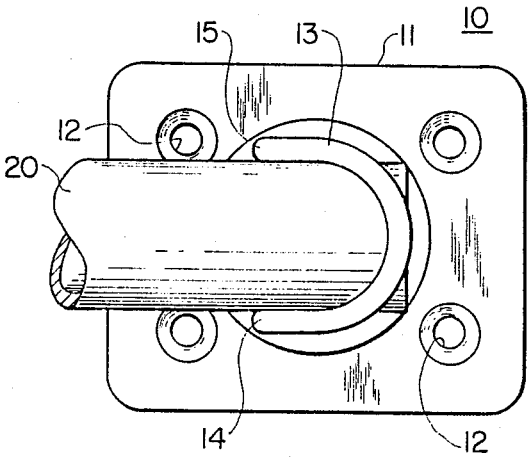
FIG. 7 is a bottom view of the bracket with a portion of the table leg halfway between its upward and downward positions.

FIG. 7 shows the same bottom view, but with a portion of the table leg pivoted half way, to show the finger lugs 14 and 15 spread to pass the upper end of the table leg between its upward and downward position.

This is a critical function of the device, and the resiliency of the finger lugs must be such that the table leg, with its leverage, can spread the lugs to pass between its upward and downward positions, but the lugs can still spring back and have enough strength to hold the leg in either its upward or downward position under average amounts of stress. The full length of the table legs provides the leverage necessary to spread these resilient, but firm, lugs apart.

The tubular pedestal must have pivot pin 16 for the upper end of the table leg 20, and an open side between the lugs 14 and 15, through which the top of the table leg can pivot.

The top of the table leg is made tubular for esthetic, as well as practical reasons. It looks attractive, and provides the taper necessary to spread the resilient lugs 14 and 15 apart when the table leg is moved between its upward position and its downward position.

The size and shape and resiliency of the lugs must be determined by the stresses that they must accomodate. For a stronger leg brace, the lugs must be tighter around the upper leg, or stiffer. However, they must be resilient enough to allow the leg to be moved from its upward position to its downward position by a person of average strength with the leverage of the leg.

The rigidity of the leg can also be increased by increasing the length of the pedestal. There is no limit to the length of the pedestal except the loss of compactness, and the increased cost of materials and molding.

The table leg must, of course, be weaker to stress against the bottom of the leg in a direction toward the lugs, and if all four legs were oriented in the same direction, the table would be vulnerable to a push against the legs in that direction, and could collapse. However, it would be normal to have the the legs each pivot in its own quadrant—as do the legs with folding braces—which would make only one leg weaker than the others to a push in a given direction.

As noted earlier, these table leg brackets may be applied to almost all forms of portable or folding tables. The standard card table would be an obvious use, but other types of tables, with more or fewer legs are also applicable. For example, a table hinged against a wall could have one or two legs, of this type, pivotable on the other end, to support the table. Elongated table could have one or more pairs of these leg mounts for intermediate support.

I claim:

1. A bracket for mounting a table leg to the underside of a table top comprising; a molded plastic unit having a base portion, and a tubular pedestal portion extending from said base portion; means for securing said base portion to said under side of said taple top; a table leg having a tubular upper end fitting within said said tubular pedestal portion; said pedestal portion having an opening on one side, and having a fixed pivoting pin extending through said pedestal and said upper end of said table leg, whereby said table leg can be pivoted between a downward position for supporting said table top, and an upward position for storing or carrying said table; a pair of resilient lugs, extending past said opening on either side of the bottom of said pedestal portion, wrapping around said tubular upper end of said table leg to secure it in either said downward position for supporting said table top or in said upward position for storing or carrying said table.

2. A bracket for mounting a table leg to the underside of a table top, as in claim 1, wherein said means for securing said base portion to said under side of said table top includes a flat flange, extending past said tubular, pedestal portion; said flange having holes to accomodate bolts for securing said base portion to said under side of said table top.

3. A bracket for mounting a table leg to the underside of a table top, as in claim 1, wherein said tubular pedestal portion is substantially perpendicular to the underside of said table top.

* * * * *